US011264695B2

(12) United States Patent
Brossier et al.

(10) Patent No.: US 11,264,695 B2
(45) Date of Patent: Mar. 1, 2022

(54) MULTIBEAM ANTENNA WITH ADJUSTABLE POINTING

(71) Applicant: Thales, Courbevoie (FR)

(72) Inventors: Jérôme Brossier, Toulouse (FR); Laurent Martin, Toulouse (FR); Jean-Marc Bassaler, Toulouse (FR)

(73) Assignee: THALES, Courbevoie (FR)

( * ) Notice: Subject to any disclaimer, the term of this patent is extended or adjusted under 35 U.S.C. 154(b) by 143 days.

(21) Appl. No.: 16/727,625

(22) Filed: Dec. 26, 2019

(65) Prior Publication Data

US 2020/0212534 A1 Jul. 2, 2020

(30) Foreign Application Priority Data

Dec. 28, 2018 (FR) ..... 18 74290

(51) Int. Cl.
*H01Q 1/12* (2006.01)
*H01Q 3/01* (2006.01)
(Continued)

(52) U.S. Cl.
CPC ..... *H01Q 1/1264* (2013.01); *H01Q 3/01* (2013.01); *H01Q 3/18* (2013.01); *H01Q 3/245* (2013.01); *H01Q 15/20* (2013.01); *H01Q 25/007* (2013.01)

(58) Field of Classification Search
CPC .. H01Q 3/01; H01Q 3/02; H01Q 3/08; H01Q 3/12; H01Q 3/16; H01Q 3/18; H01Q 3/24; H01Q 3/245; H01Q 19/17; H01Q 19/175; H01Q 25/007; H01Q 15/20; H01Q 1/12; H01Q 1/125; H01Q 1/1264; H01Q 1/28; H01Q 1/288; H01Q 25/00
See application file for complete search history.

(56) References Cited

U.S. PATENT DOCUMENTS 4,338,607 A * 7/1982 Drabowitch ..... G01S 13/42 342/78
5,229,781 A * 7/1993 Losquadro ..... H01Q 3/20 343/763

(Continued)

FOREIGN PATENT DOCUMENTS

| | | |
|---|---|---|
| CN | 106785444 A | 5/2017 |
| EP | 1437796 A1 | 7/2004 |
| JP | 02033202 A | 2/1990 |

OTHER PUBLICATIONS

French Search Report issued by the French Patent Office corresponding to French Patent Application No. FR 1874290, dated Oct. 8, 2019.

*Primary Examiner* — Tho G Phan
(74) *Attorney, Agent, or Firm* — Arent Fox LLP

(57) ABSTRACT

This invention concerns a multibeam antenna with adjustable pointing, comprising a single reflection arrangement and a plurality of radiating sources arranged opposite the reflection arrangement and suited to emit and/or receive radiofrequency (RF) signals, the reflection arrangement defining a centre, a focal plane, and a focal point located on the focal plane.

The antenna is characterised in that at least one of the radiating sources ('mobile source') is movable substantially independently of the or each other radiating source on a scanning surface to adjust the pointing of the antenna, wherein the scanning surface coincides with the focal plane or is tangential to it at the focal point.

14 Claims, 10 Drawing Sheets

(51) Int. Cl.

| | |
|---|---|
| ***H01Q 15/20*** | (2006.01) |
| ***H01Q 25/00*** | (2006.01) |
| ***H01Q 3/24*** | (2006.01) |
| ***H01Q 3/18*** | (2006.01) |

(56) References Cited

U.S. PATENT DOCUMENTS

| | | | | |
|---|---|---|---|---|
| 5,473,335 | A * | 12/1995 | Tines | H01Q 3/04 248/652 |
| 6,535,177 | B1 * | 3/2003 | Dhellemmes | H01Q 1/084 343/765 |
| 8,456,376 | B2 * | 6/2013 | Yang | H01Q 1/125 343/882 |
| 10,249,951 | B2 * | 4/2019 | Runyon | H01Q 3/08 |
| 10,581,152 | B2 * | 3/2020 | Ferrando | H01P 1/068 |
| 10,665,929 | B2 * | 5/2020 | Gaudette | H01Q 1/125 |

* cited by examiner

MULTIBEAM ANTENNA WITH ADJUSTABLE POINTING

This application claims priority to French Patent Application No. 18 74290, filed on Dec. 28, 2018. The disclosure of the priority application is incorporated in its entirety herein by reference.

FIELD OF THE INVENTION

This invention concerns a multibeam antenna with adjustable pointing.

The invention is particularly applicable to spatial-domain reflector antennas, and, in particular, to satellite missions requiring independent re-pointing of radiofrequency (RF) beams. One particular example are the 'gateway' antennas on geostationary satellites.

BACKGROUND OF THE INVENTION

These antennas generally aim at various points on the Earth's surface, the positions of which may vary, independently of one another, over the course of the mission of the satellite. In this case, it becomes necessary to re-point, i.e. reorient, the beam of the antenna corresponding to the point whose position has changed. This may also relate to a new position of the satellite, which, in this case, requires reorientation of the points on the Earth at which it aims.

To this end, it is known from the prior art to use various re-pointing methods that are selected based on the type of antenna that is used.

In particular, to re-point a passive reflector antenna, it is possible either to move the entire antenna body or to move only the reflector(s) at the limit of the change in performance of the RF signals. In both cases, the reorientation is carried out mechanically.

Thus, it is clear that, in order to be able to carry out a mechanical reorientation for each target point independently of the other points, it is necessary to provide a radiating source and one or more of the reflectors for each target point.

Of course, this results in significant overcrowding of the outer surface of the satellite, considerably increasing its mass.

Re-pointing is easier in the case of active antennas.

In fact, unlike passive antennas, the radiating sources of active antennas form a network, and are associated with a system that distributes the RF signals amongst these sources based on amplitude and/or phase and a system for controlling this distribution based on predetermined laws.

Active antennas thus allow for 'electronic' re-pointing, i.e. without any mechanical action upon the antenna.

Thus, active antennas offer a great deal of flexibility in terms of the reorientation of the beams associated with the various target points. This flexibility, on the other hand, implies that these antennas have a high degree of complexity, increased mass, consumption, and dissipation, which are critical on satellites.

SUMMARY OF THE INVENTION

This invention seeks to propose a multibeam antenna that allows for independent re-pointing of beams that is also space-saving, relatively lightweight, and has a simple structure.

To this end, the invention concerns a multibeam antenna with adjustable pointing, comprising a single reflection arrangement and a plurality of radiating sources arranged opposite the reflection arrangement and suited to emit and/or receive RF signals, the reflection arrangement defining a centre, a focal plane, and a focal point located on the focal plane;

the antenna being characterised in that at least one of the radiating sources ('mobile source') is movable substantially independently of the or each other radiating source on a scanning surface to adjust the pointing of the antenna, wherein the scanning surface coincides with the focal plane or is tangential to it at the focal point.

According to other advantageous aspects of the invention, the antenna comprises one or more of the following characteristics, alone or in any combination technically possible:

the mobile source is movable within the scanning surface according to at least two degrees of freedom;

each of the two degrees of freedom comprises rotation about an axis, one of which axes is the primary axis of rotation and the other is the secondary axis of rotation;

- the primary axis of rotation and the secondary axis of rotation are perpendicular to the focal plane, wherein the scanning surface then coincides with the focal plane, or
- the primary axis of rotation is perpendicular to the focal plane and passes through the focal point of the reflection arrangement, and the secondary axis of rotation is inclined relative to the focal plane such that, in all positions, the movable source is orientated towards the centre of the reflection arrangement, wherein the scanning surface is then tangential to the focal plane at the focal point, or
- the primary axis of rotation is located outside of the focal point, and the primary axis of rotation and the secondary axis of rotation are inclined relative to the focal plane, such that, in all positions, the movable source is orientated towards the centre of the reflection arrangement, the scanning surface then being tangential to the focal plane at the focal point;

the primary axis of rotation is translationally fixed;

the antenna includes several mobile sources analogous to the mobile source;

the primary axes of rotation of the mobile sources are arranged symmetrically around the focal point;

the antenna further comprises, for the/each mobile source, a support fixed on a baseplate and comprising an upper arm that rotates about the primary axis of rotation of the corresponding mobile source and an arm that rotates about the secondary axis of rotation of the corresponding mobile source and defines a mounting end of the mobile source;

the/each support further comprises at least one stepper motor that is suited to rotate the upper arm or the arm of the support about the corresponding axis;

the/each support further comprises at least one rotating joint that connects the upper arm with the baseplate or the arm with the upper arm of the support, the rotating joint being suited to transmit RF signals and/or electrical current between these elements;

the/each rotating joint comprises at least one channel for transmitting RF signals, the transmission channel being delimited by a plurality of plugs spaced apart from one another;

the arm of the/each support rotates within a rotation surface ('upper rotation surface'), and at least one part of the upper arm of the support rotates within a plane of rotation ('lower plane of rotation'), the lower plane of rotation being parallel to the focal plane and the upper rotation surface lying between the focal plane and the lower rotation surface;

when it comprises several mobile sources, the lower planes of rotation of the upper arms of at least two supports coincide;

it comprises several mobile sources, the upper rotation surface and the lower plane of rotation of the arm and upper arm of at least one support are between the scanning surface and the upper rotation surface and the upper rotation surface and the lower plane of rotation of the arm and the upper arm of at least one other support;

when it comprises several mobile sources, the upper rotation surface of the arm of at least one support is included within the lower plane of rotation of the upper arm of at least one other support; and the reflection arrangement is mobile.

BRIEF DESCRIPTION OF THE DRAWINGS

These characteristics and advantages of the invention will become apparent upon a reading of the following description, given by way of example only and without limitation, by reference to the drawings appended hereto, in which.

DETAILED DESCRIPTION OF THE INVENTION

Figure 1:
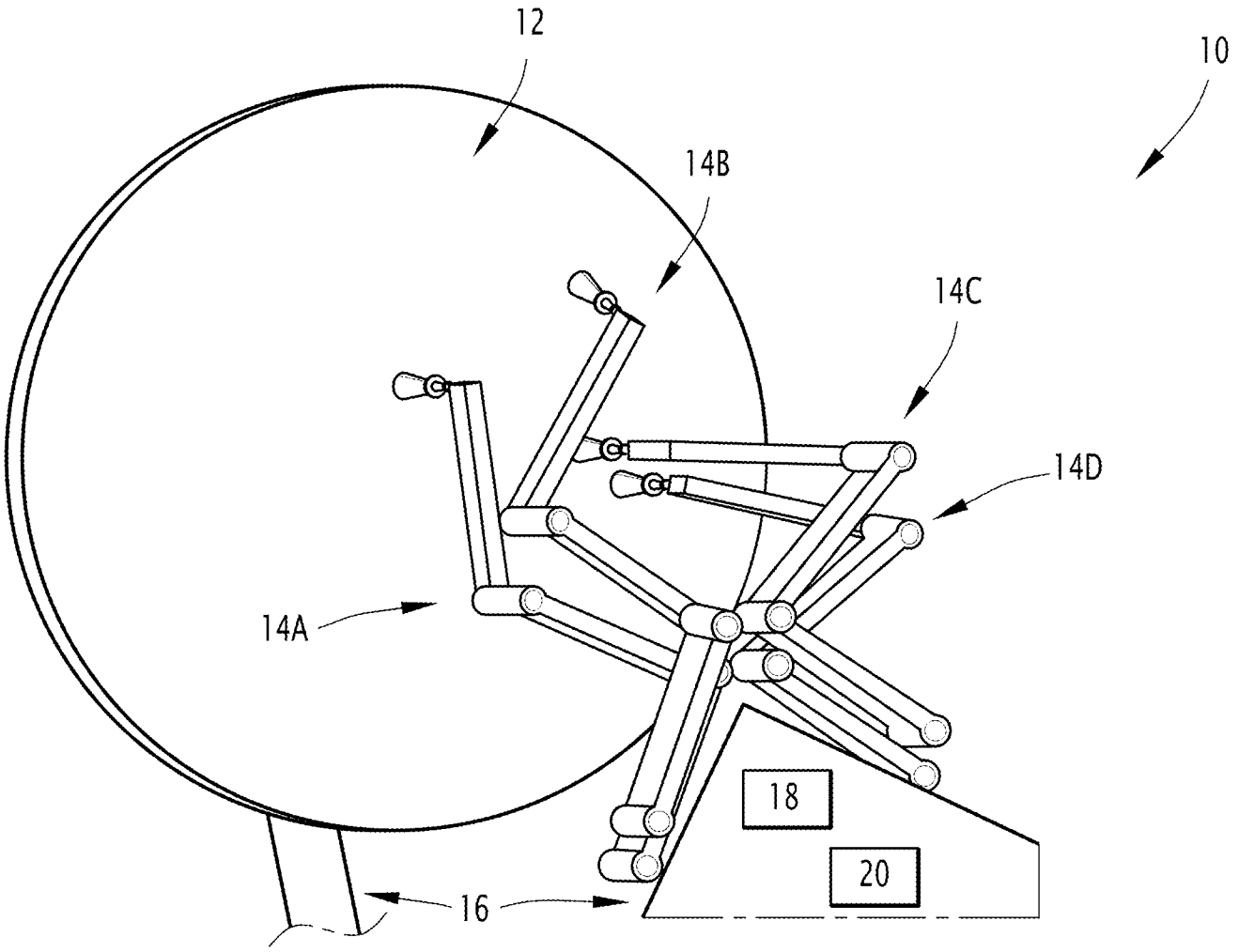
FIG. 1 is a schematic perspective view of a multibeam antenna according to a first embodiment of the invention, wherein the antenna comprises, in particular, a plurality of mobile assemblies.

The antenna 10 of FIG. 1 is a multibeam antenna with adjustable pointing.

According to one exemplary embodiment of the invention, this antenna 10 is located on board a satellite and, more specifically, it is mounted on an outer surface thereof that is orientated, e.g., towards the Earth.

For example, the satellite is a geostationary satellite carrying out a telecommunications mission and requiring 'gateway' antennas. As is known, such a mission must allow the antenna 10 of the satellite to exchange RF signals with several antennas arranged on the ground.

The positions, as well as the number, of these ground antennas may change over time over the mission of the satellite.

The antenna 10 allows its beams to be re-pointed independently of one another in order to adapt to these changes on the ground, as will be explained below.

Referring to FIG. 1, the antenna 10 comprises a single reflection arrangement 12, a plurality of mobile assemblies 14A-14D, a baseplate 16, a processing module 18, and a control module 20.

The reflection arrangement 12 has a reflector in any known form or several reflectors, preferably two, also having known forms.

Thus, in one exemplary embodiment, the reflection arrangement 12 has a single centred or single-offset reflector.

In another exemplary embodiment, the reflection arrangement 12 has two reflectors and is, e.g., a SFOCA (Side-Fed Offset Cassegrain Antenna), Gregorian, Cassegrain, splash-plate, etc. antenna.

As is also known, the geometry of the reflection arrangement 12 defines a centre on its surface and a focal point located outside this surface. This reflection arrangement 12 further defines a focal plane corresponding to the plane containing the focal point and perpendicular to the line connecting the focal point and the centre.

The mobile assemblies 14A-14D are, e.g., four in number and allow for the sending and/or receiving of beams of RF signals originating from various target points or directed at these points.

In the event of a change in the position and/or number of these points, changes in the positions of the mobile assemblies 14A-14D allow the antenna 10 to be reoriented, as will be discussed in detail below.

The baseplate 16 allows the reflection arrangement 12 and the mobile assemblies 14A-14D to be affixed to the structure of the satellite, and thus takes any form suitable to this end.

Thus, in the example shown in FIG. 1, the baseplate 16 is in the form of a plurality of fixing feet, each foot being adapted to affix one of the mobile assemblies 14A-14D or the reflection arrangement 12 to the structure of the satellite.

These fixing feet are thus arranged depending on the corresponding structure of the satellite. In FIG. 1, the structure comprises two perpendicular surfaces, such that at least some of the fixing feet are affixed to one of the surfaces and some others to the other surface.

Additionally, the fixing feet of the mobile assemblies 14A-14D comprise transmission means necessary in order to transmit RF signals and electrical current between these assemblies 14A-14D and the processing module 18 and the control module 20.

The processing module 18 allows for the acquisition of RF signals received by the mobile assemblies 14A-14D and/or the generation of RF signals for transmission by these assemblies.

To this end, the processing module 18 comprises electronic components such as amplifiers, a splitter, etc. These components are known from the prior art and will not be discussed in detail.

The control module 20 allows for the positions of the mobile assemblies to be changed in order to reorient the beams of the antenna 10 based on the target points. To this end, the control module 20 is suited to control the position of each of the mobile assemblies 14A-14D and to change it independently of the other assemblies, e.g., by transmitting a command adapted to this assembly.

For example, the control module 20 takes, at least in part, the form of a programmable logic circuit or that of software. In the former case, it is implemented by a suitable processor.

In the first embodiment of the antenna 10, the mobile assemblies 14A-14D are substantially identical.

Thus, in the following, only the mobile assembly 14A will be discussed in detail by reference to FIGS. 2-4.

Figure 2:
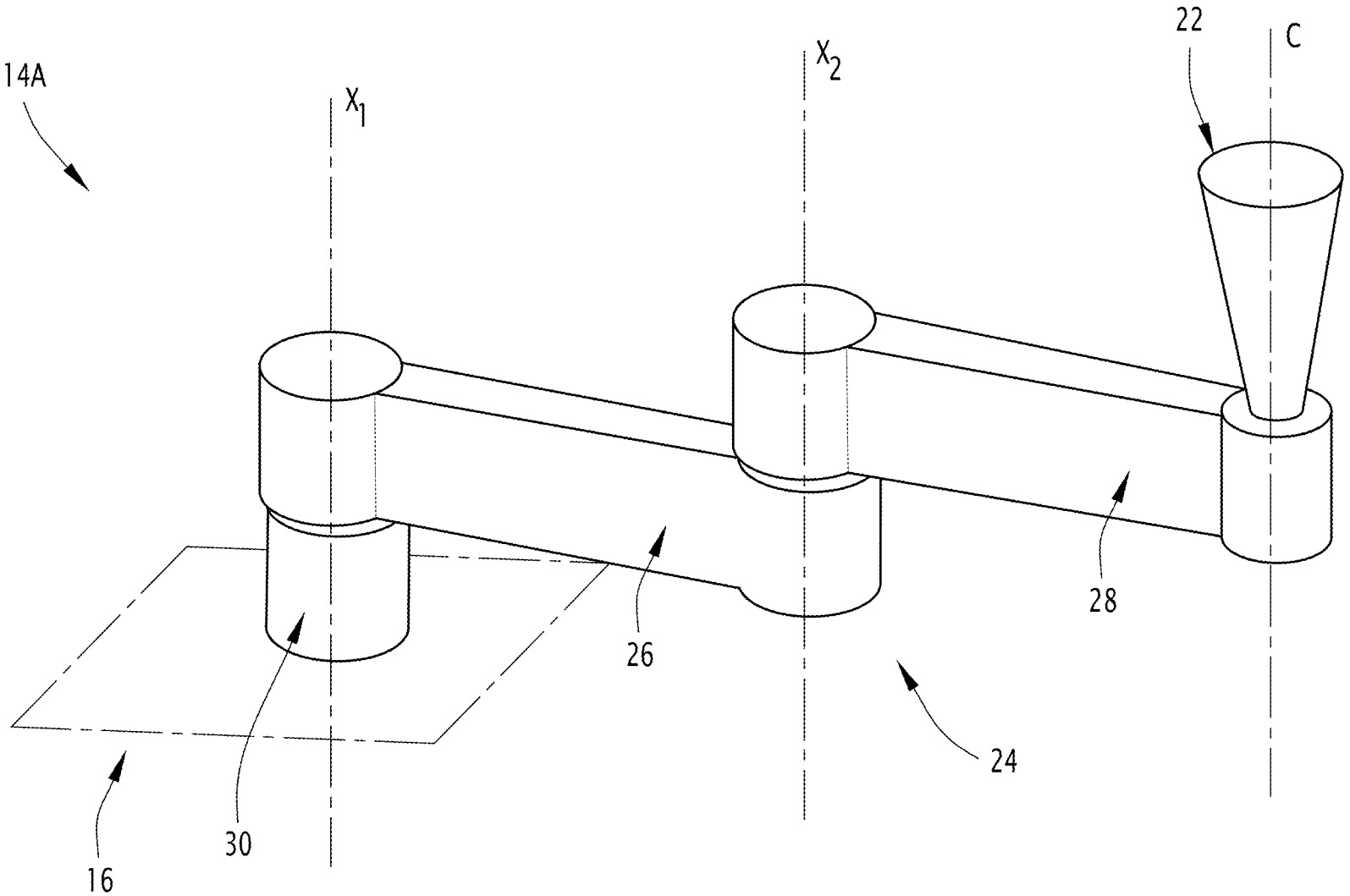
FIG. 2 is a schematic perspective view of one of the mobile assemblies of FIG. 1 in a first exemplary embodiment thereof.
Figure 3:
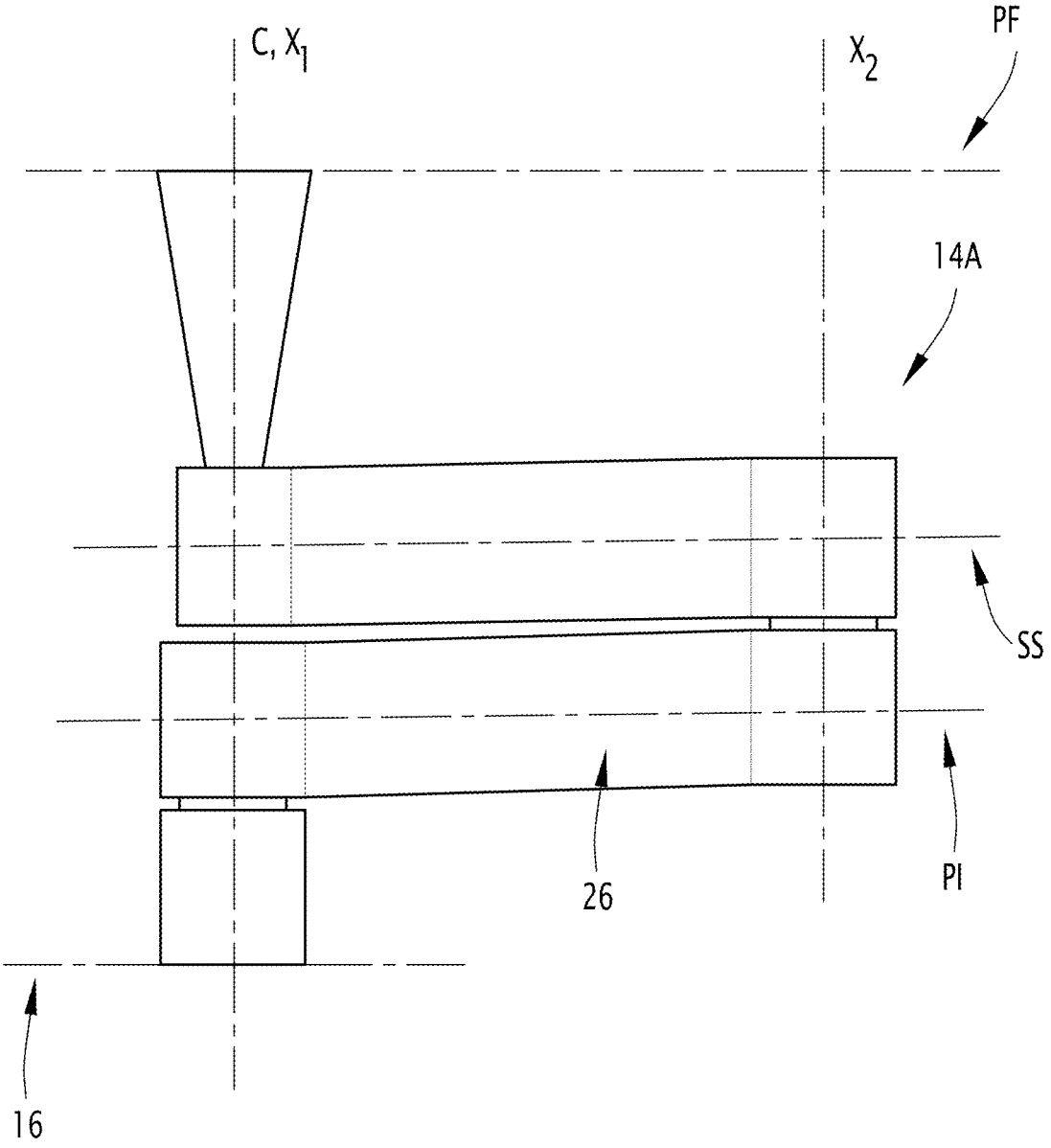
FIG. 3 is a schematic side view of the mobile assembly of FIG. 2 in a different position to that of FIG. 2.

In particular, FIGS. 2 and 3 show such a mobile assembly 14A in a first exemplary embodiment thereof.

Referring to FIG. 2, the mobile assembly 14A comprises a radiating source 22 and a support 24 that affixes this source 22 movably to the base 16.

For example, the radiating source 22 takes the form of a horn for the transmission and/or reception of RF signals that is elongated along a source axis C.

This source axis C is orientated towards the reflection arrangement 12, and, in the first exemplary embodiment of the assembly 14A, it is perpendicular to the focal plane PF in all positions of the assembly 14A.

Additionally, in the first exemplary embodiment of the assembly 14A, the support 24 allows the radiating source 22 to move within a scanning surface that coincides with the focal plane of the reflection arrangement 12.

This focal plane can be seen in FIG. 3, and is indicated by the reference 'PF' in FIG. 3.

In particular, the support 24 allows the radiating source 22 to move within the focal plane PF according to two degrees of freedom that, in the example of FIG. 2, comprise two rotations about parallel axes that are perpendicular to the focal plane PF.

One of these axes is known as the 'primary axis of rotation' X1 and the other as the 'secondary axis of rotation X2'. Furthermore, the primary axis of rotation X1 is translationally fixed relative to the baseplate 16.

To ensure that the radiating source 22 is moved according to two degrees of freedom within the focal plane PF, the support 24 comprises an upper arm 26 that rotates relative to the primary axis of rotation $X_1$ within a plane of rotation ('lower plane of rotation') Pl, and an arm 28 that rotates relative to the secondary axis of rotation X2 within a rotation surface ('upper rotation surface') SS.

As can be seen in FIG. 3, the upper rotation surface SS is arranged between the focal plane PF and the lower plane of rotation Pl.

Additionally, in the first exemplary embodiment of the assembly 14A, this upper rotation surface SS has a plane.

The upper arm 26 is elongated and has two ends. One of these ends is fixed so as to rotate about the primary axis of rotation $X_1$ on a stator 30 rigidly connected to the baseplate 16. The other end is affixed to the arm 28 so as to rotate about the secondary axis of rotation $X_2$.

Analogously, the arm 28 is elongated and thus has two ends. One of these ends is affixed to the upper arm 26 so as to rotate about the secondary axis of rotation X2, and the other receives the radiating source 22 in a fixed manner.

The longitudinal extents of the arm 28 and the upper arm 26 are, e.g., substantially identical, as can be seen in FIG. 3. In another exemplary embodiment, these extents are different, and are adapted to the arrangement of the other mobile assemblies in order to ensure more scanning of the scanning surface.

To implement the rotation about the axes X1 and X2, the support 24 advantageously comprises two motors, one of which is incorporated in the junction between the upper arm 26 and the stator 30, and the other is incorporated in the junction between the arm 28 and the upper arm 26.

For example, these motors have stepper motors that can be controlled by the control module 20. In this case, the commands transmitted by the control module 20 to the assembly 14A correspond to electrical currents having a suitable voltage.

The control module 20 is thus suited to adequately supply these motors via means for transmitting electrical current that are incorporated within the stator 30 and the upper arm 26.

To ensure that these means are connected between the stator 30 and the upper arm 26, these transmission means have flexible cables within this junction, or comprise an electrical rotating joint that allows for transmissions by cable between these components to be avoided.

To ensure the transmission of the RF signals between the radiating source 22 and the processing module 18, the support 24 comprises RF signal transmission means. These means comprise, e.g., waveguides incorporated into the arm 28 and the upper arm 26, as well as two rotating RF joints. One of these rotating RF joints is incorporated into the junction between the arm 28 and the upper arm 26, and the other is incorporated into the junction between the upper arm 26 and the stator 30.

Advantageously, each of these rotating RF joints has a 'groove gap' rotating joint, i.e. a rotating joint comprising at least one channel for the transmission of RF signals that is delimited by plots spaced a predetermined distance from one another.

More advantageously, each of the rotating joints used for the transmission of the RT signals, or at least the rotating joint incorporated into the junction between the arm 28 and the upper arm 26, is configured to allow for 360° of rotation about the axis.

Figure 4:
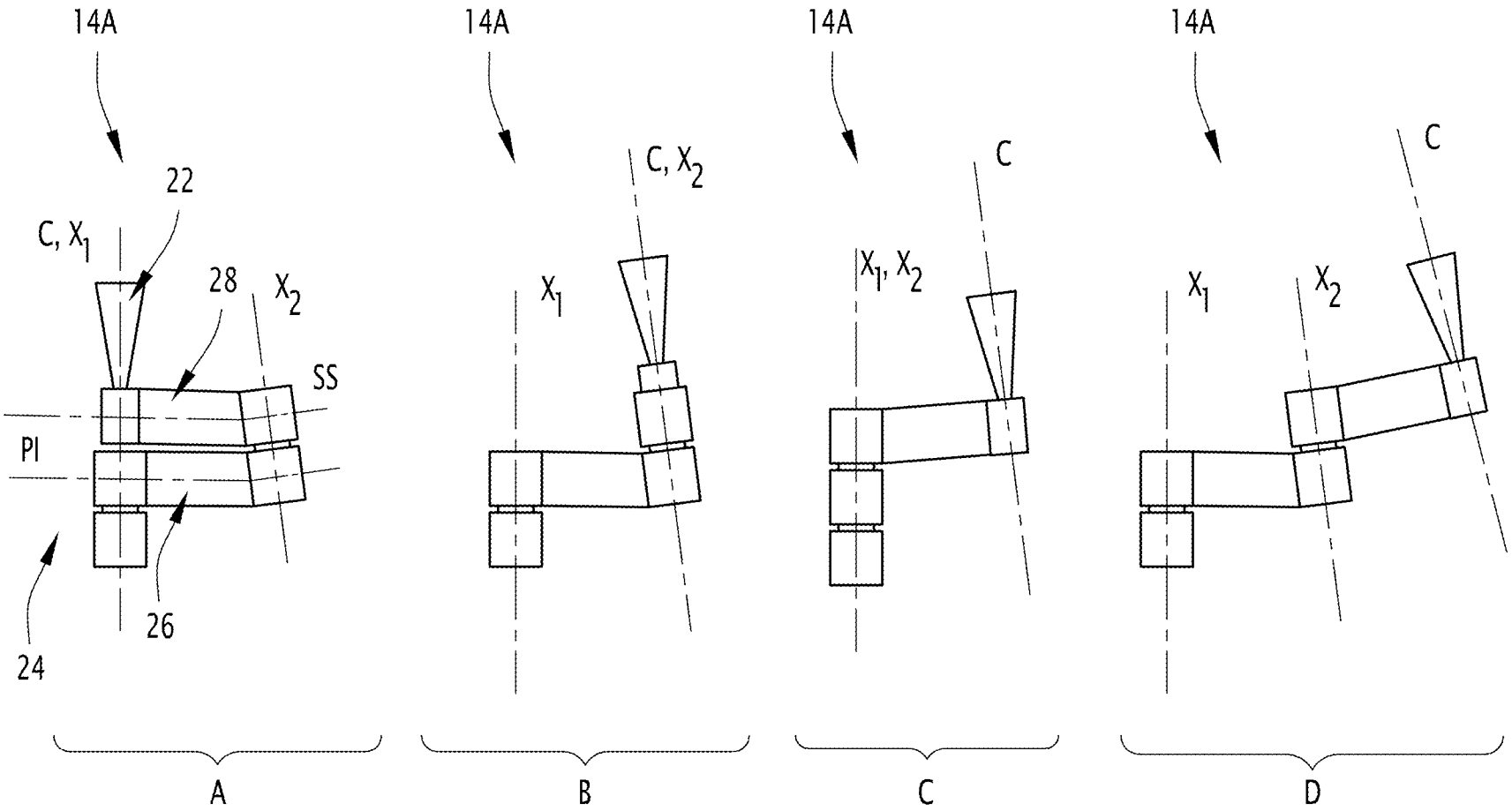
FIG. 4 is a schematic perspective side view of various positions of one of the mobile assemblies of FIG. 1 in a second exemplary embodiment thereof.

A mobile assembly 14A according to a second exemplary embodiment is shown in detail in FIG. 4 in its various positions A)-D).

The mobile assembly 14A according to this exemplary embodiment is substantially analogous to that described above.

Unlike the assembly 14A described above, in the mobile assembly according to this second exemplary embodiment, the secondary axis of rotation $X_2$ is inclined relative to the primary axis of rotation $X_1$, whilst the primary axis of rotation $X_1$ is situated on the focal point of the reflection arrangement and always remains perpendicular to the focal plane PF.

The angle of incline of the secondary axis of rotation $X_2$ is selected such that, in any position of the assembly 14A, the radiating source 22 is orientated towards the centre of the reflection arrangement 12. In other words, this angle is selected such that the source axis C is orientated towards the centre of the reflection arrangement 12.

Thus, in this exemplary embodiment, the radiating source 22 is movable within a scanning surface tangential to the focal plane at the focal point. This scanning surface thus has a convex area extending, near the focal plane on a single side thereof, between the reflecting arrangement 12 and the focal plane.

In the exemplary embodiment of FIG. 4, the angle of incline of the secondary axis of rotation $X_2$ is substantially equal to 4.5° . This value depends on the geometry of the antenna.

Furthermore, in the example of FIG. 4, to form an incline of the secondary axis of rotation $X_2$, the adjacent ends of the upper arm 26 and the arm 28 are bent at the same angle.

Thus, in this case, at least one part of the upper arm 26 that comprises the end that rotates about the primary axis of rotation continues to rotate within the lower plane of rotation Pl, as described above, whilst the upper rotation surface is different to a plane and corresponds to a conical surface.

The upper rotation surface SS lies between the scanning surface and the lower plane of rotation Pl. This then allows the arm 28 to rotate independently of the upper arm 26.

In FIG. 4, in position A), the arm 28 and the upper arm 26 extend in the same direction, and the source axis C coincides with the primary axis of rotation $X_1$.

In positions B) and C), the arm 28 and the upper arm 26 extend in perpendicular directions.

Thus, in position B), the source axis C is inclined relative to the primary axis of rotation $X_1$ in the plane of the drawing and relative to the secondary axis of rotation $X_2$ in a plane perpendicular to the plane of the drawing.

In position C), the source axis C is inclined relative to the primary axis of rotation $X_1$ in the plane of the drawing, and the primary axis of rotation $X_1$ is inclined relative to the secondary axis of rotation $X_2$ in the plane perpendicular to the plane of the drawing.

In position D), the arm 28 and the upper arm 26 both extend within the plane of the drawing, and the source axis C and the secondary axis of rotation $X_2$ are thus inclined relative to the primary axis of rotation $X_1$ in this plane, whilst the tilt angle of the source axis C is double the tilt angle of the secondary axis of rotation $X_2$.

Figure 5:
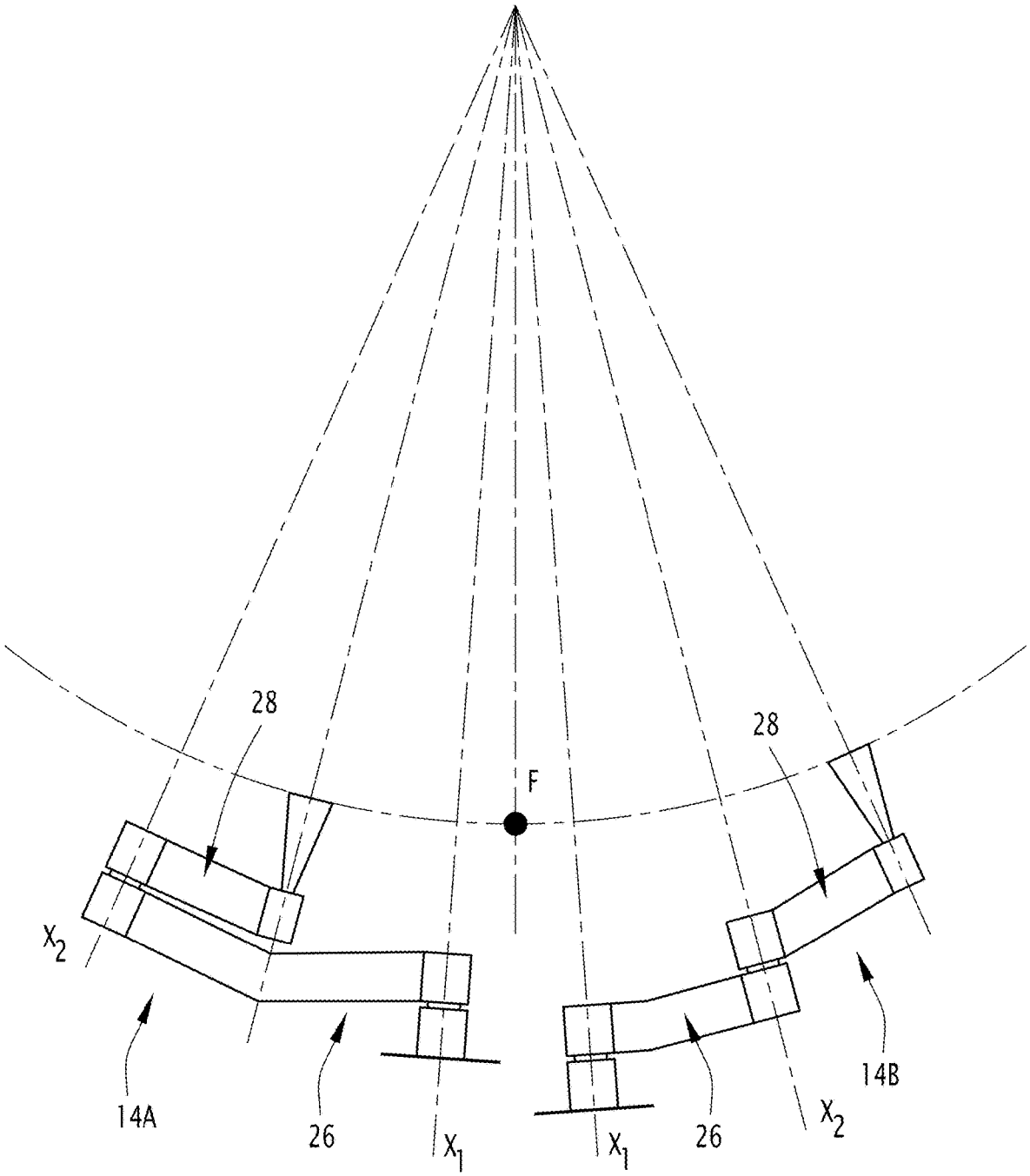
FIG. 5 is a schematic perspective side view of one variant of one of the mobile assemblies of FIG. 1 in the second exemplary embodiment thereof.

One variant of this exemplary embodiment of the mobile assembly 14A is shown in FIG. 5. In this variant, the primary axis of rotation $X_1$ of the upper arm 26 is near the focal point F and thus does not pass through the focal point.

Thus, in this exemplary embodiment, the primary axis of rotation X1 is inclined so as to aim at the centre of the reflector 12. The arrangement of the arm 28 relative to the upper arm 26 remains as described in relation to FIG. 4.

This variant is particularly advantageous where the primary axis of rotation X1 of each of the mobile assemblies 14A-14D is arranged near the focal point, as described below.

In FIG. 5, the two mobile assemblies 14A and 14B can be seen. In this drawing, it is clear that the scanning surface described by the sources of these assemblies 14A and 14B is a spherical section. Furthermore, in the example of FIG. 5, the arm 28 of each of the assemblies 14A, 14B has a length less than that of the corresponding upper arm 26, and only the end of the upper arm 26 adjacent to the arm 28 is bent. In this case, in at least one position, the arm 28 extends along the bent part of the upper arm 26. The arm 28 thus rotates in a plane that intersects with the plane of rotation of the upper arm 26.

Of course, this variation of the arrangement of the arm and the upper arm remains applicable to the exemplary embodiment of FIG. 4, i.e. where the primary axis of rotation passes through the focal point.

More generally and advantageously in terms of antenna performance, each of the assemblies 14A-14D is designed such that, no matter its position and rotational axes, the axis of the source is directed at the centre of the reflection arrangement.

Thus, no matter the position of the arms, the axis of each source is directed at the centre of the reflection arrangement 12.

Generally, it is possible to arrange N mobile assemblies analogous to the mobile assemblies 14A and 14B of FIG. 5 in this manner, such that their radiating sources are directed at the centre of the reflection arrangement and, advantageously, describe a single scanning surface that is a spherical section.

Figure 6:
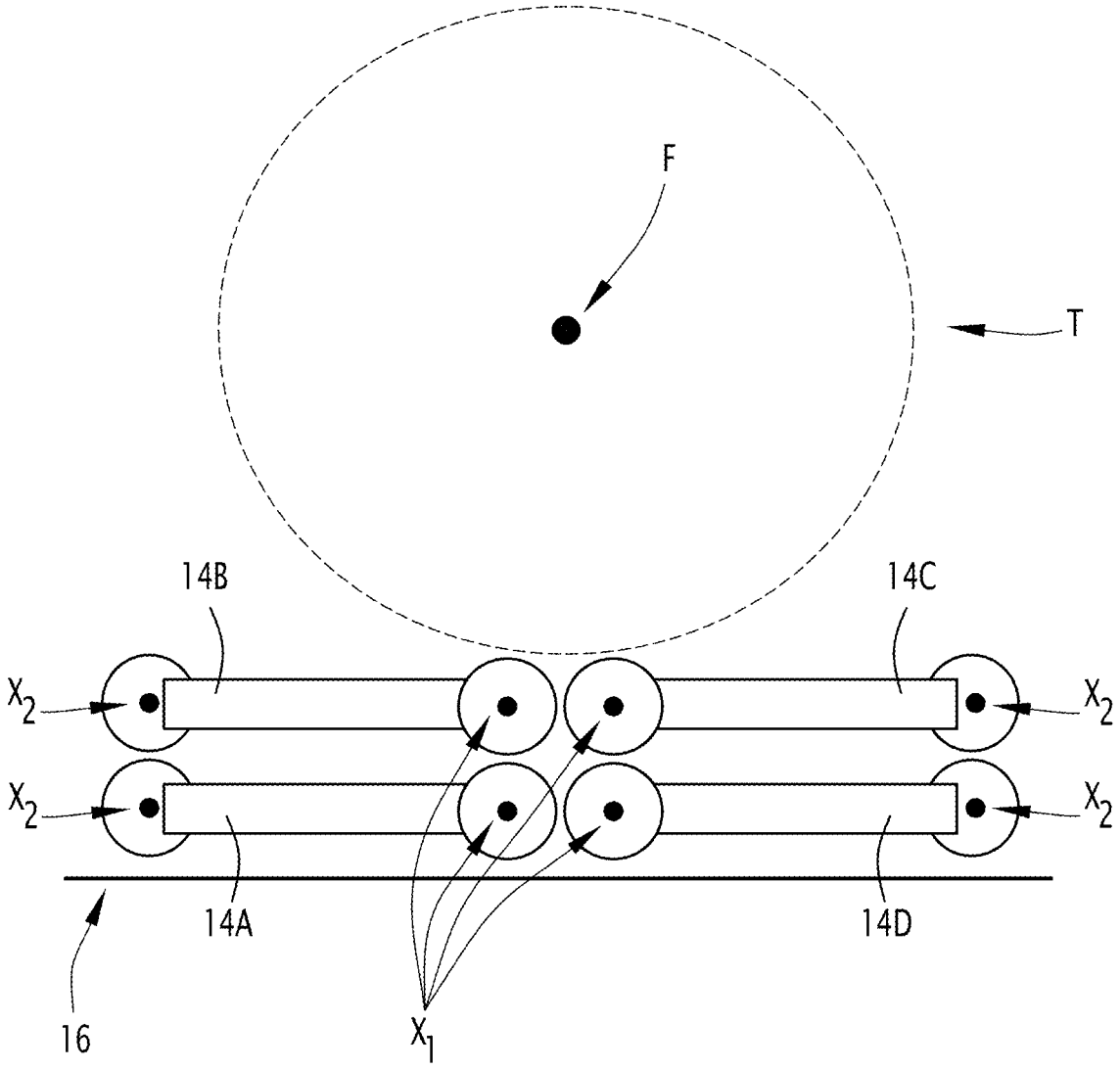
FIGS. 6 and 7 are schematic views of other variants of one of the mobile assemblies of FIG. 1 in the second embodiment.
Figure 7:
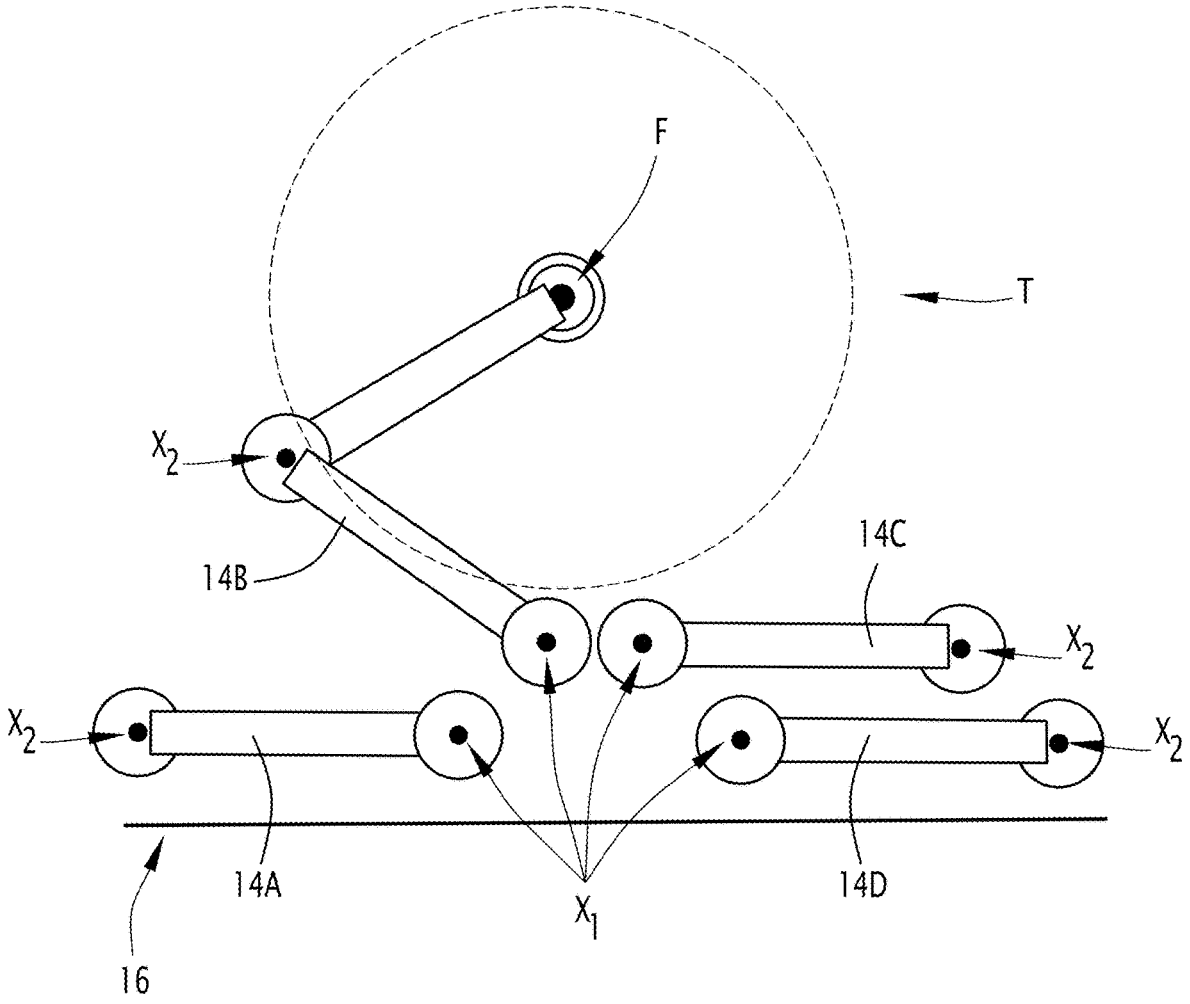

Thus, in other variants of the second exemplary embodiment of the mobile assembly 14A that are shown in FIGS. 6 and 7, the primary axis of rotation X1 of this assembly 14A, as well as the analogous assemblies 14B-14D, are arranged far from the focal point F.

In this case, each of the assemblies 14A-14D, and, in particular, their axes X1 and X2, are configured such that the corresponding source axes are directed at the centre, or a point near the centre, of the reflection arrangement. The sources are then movable over a section of a sphere, as described above.

This allows the focal point F of the reflection arrangement 12 to be offset so as to arrange a scanning surface centred on the focal point, as shown in FIGS. 6 and 7.

In fact, FIGS. 6 and 7 show one possible arrangement of the mobile assemblies 14A-14D on the baseplate 16 with an offset focal point. The circle T, for example, in FIGS. 6 and 7 represents the image of the Earth as seen from the focal point of the reflection arrangement. Thus, it is understood that offsetting the focal point F advantageously allows for the entire Earth to be scanned.

Figure 8:
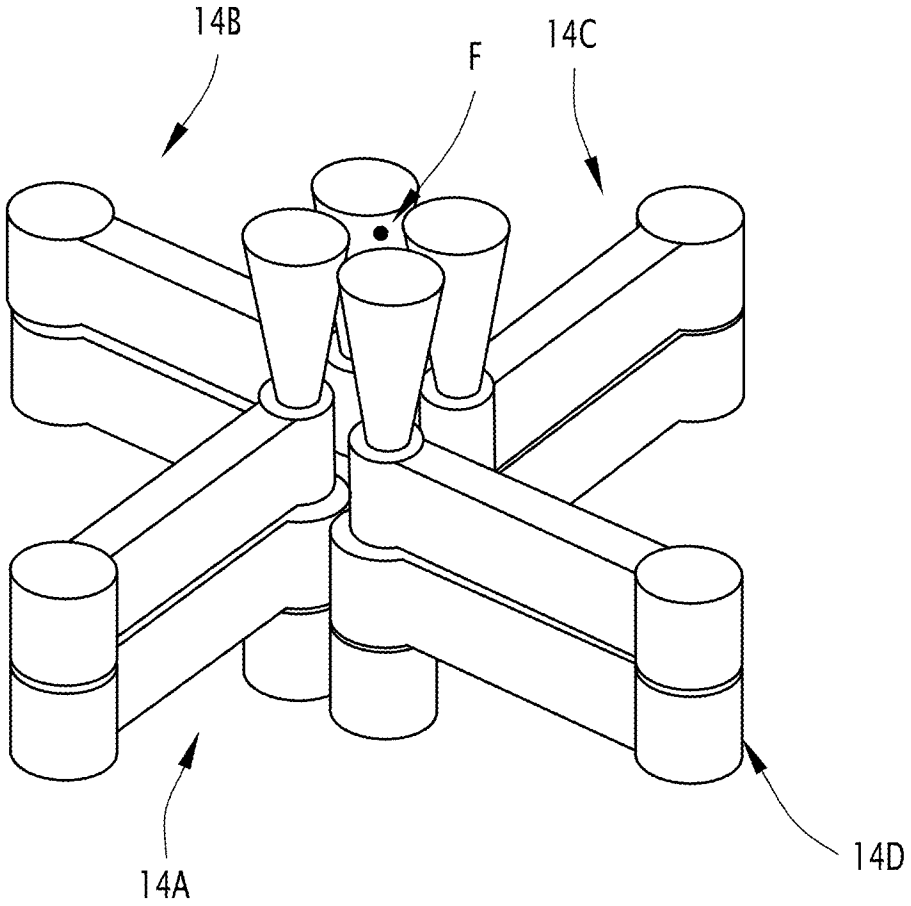
FIGS. 8 and 9 are schematic perspective views of various respective positions of the mobile assemblies of FIG. 1.
Figure 9:
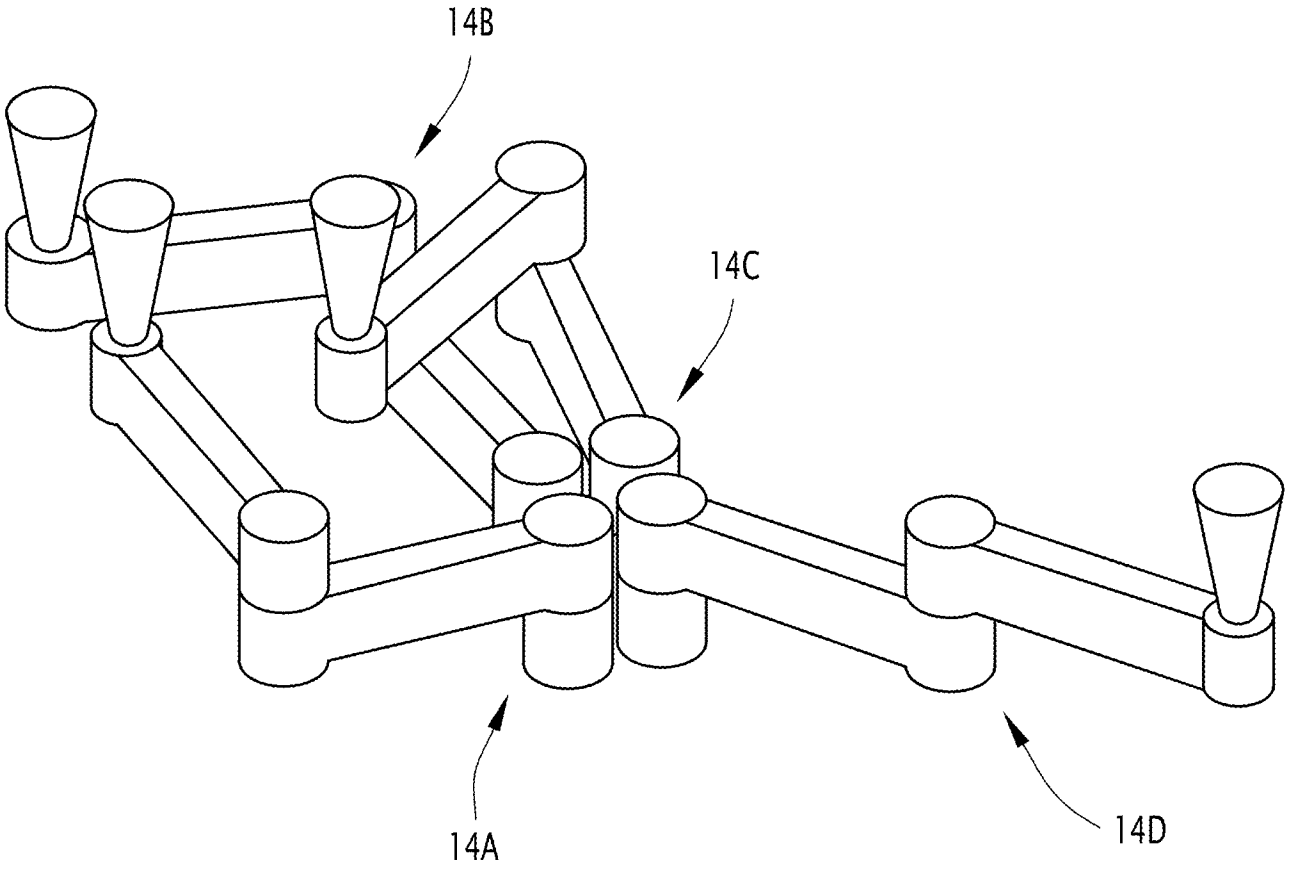

Another possible arrangement of the mobile assemblies 14A-14D on the baseplate 16 is shown in FIGS. 8 and 9.

In particular, these images illustrate an arrangement of these assemblies 14A-14D according to the first exemplary embodiment of each of them, but may also be applied to assemblies according to the second exemplary embodiment.

Thus, in these images, the mobile assemblies 14A-14D are arranged symmetrically around the focal point F of the reflection arrangement 12. Additionally, the primary axes of rotation $X_1$ of these assemblies are advantageously arranged as near as possible to the focal point and directed at the centre of the reflection arrangement.

Furthermore, these assemblies 14A-14D are arranged such that the lower planes of rotation Pl of their upper arms 26 coincide. In other words, in this type of arrangement, the arm 28 of each assembly 14A-14D is above the upper arm 26 of each assembly 14A-14D. This facilitates respective movements of the corresponding radiating sources 22 in order to scan a larger part of the scanning surface.

FIG. 8 shows the initial positions of the mobile assemblies 14A-14D, e.g., when the satellite is launched.

FIG. 9 shows the operational positions of these assemblies. These positions may be changed over the course of the satellite's mission. In this case, it can be seen that this invention has a certain number of advantages.

In particular, the invention proposes an antenna comprising radiating sources that are movable with the focal plane or near it. The invention allows for the positions of these radiating sources to be changed independently of one another, thus mechanically changing the pointing of the antenna.

This makes it possible to avoid using the complex and heavy electronic components of active antennas that implement electronic pointing.

It additionally makes it possible to use a single reflection arrangement, which allows for a significant reduction in mass and use of space in the antenna in the case of passive antennas that use mechanical pointing.

The antenna according to the invention thus allows for flexible pointing without the addition of heavy, complex components.

A multibeam antenna according to a second embodiment will now be described by reference to FIG. 10.

With the exception of the mobile assemblies, this antenna according to the second embodiment is substantially analogous to the antenna 10 described above.

In particular, the antenna of the second embodiment comprises four mobile assemblies 114A-114D, at least one of which differs from the other assemblies.

Figure 10:
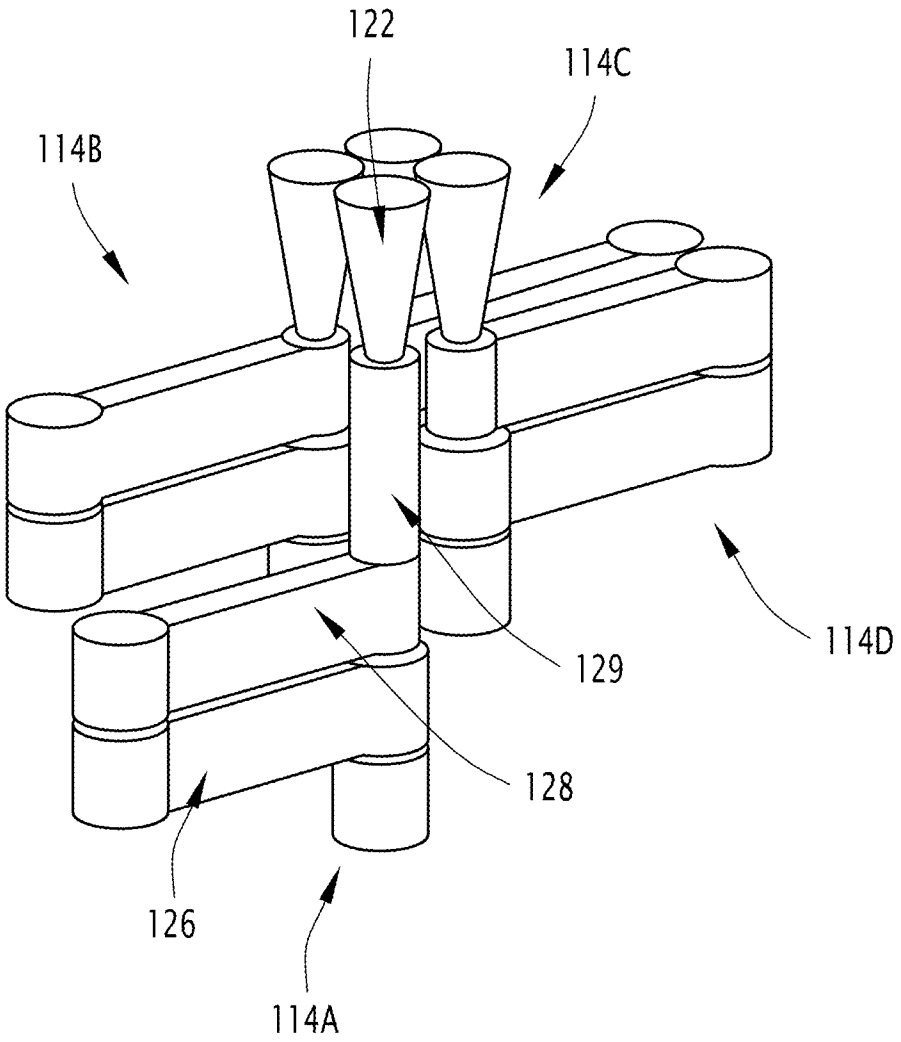
FIG. 10 is a schematic perspective view of a plurality of mobile assemblies according to a second embodiment of the invention.

Thus, in the example of FIG. 10, the assemblies 114B-114D are identical to the assemblies 14B-14D described above, and are thus identical to one another.

On the other hand, the assembly 114A differs from each of these assemblies in that one end 129 of the arm 128 supports the radiating source 122.

In this second embodiment, this end is elongated and has a length equal, e.g., to the sum of the transverse extents of the arm and upper arm, e.g., of the assembly 114B.

Thus, when the mobile assemblies 114A-114D are arranged, e.g., symmetrically around the focal point, the arm 128 and the upper arm 126 of the assembly 114A are arranged below the arm and the upper arm of each other mobile assembly 114B-114D.

In other words, in this case, the upper rotation surfaces SS and the lower planes of rotation Pl of the supports of the assemblies 114B-114D lie between the scanning surface and the upper rotation surface SS and the lower plane of rotation Pl of the support of the mobile assembly 114A.

To put it differently, the arm and the upper arm of the support of the mobile assembly 114A are arranged below the arms and the upper arms of the other mobile assemblies 114B-114D.

It is also possible to arrange these assemblies 114A-114D such that the upper rotation surface of the arm 128 of at least one support is within the lower plane of rotation Pl of the upper arm 126 of at least one other support.

In this case, the arm 128 of at least one support is arranged at the level of the upper arm 126 of at least one other support.

This makes more space available for the movement of the various assemblies.

Of course, other embodiments are equally possible.

For example, it is possible to make the reflection arrangement 12 movable according to at least one degree of freedom. This would make the pointing of the antenna of the first or second embodiment even more flexible.

It is also possible mount at least one radiating source unmovably, e.g., on the focal point of the antenna and to arrange the other radiating sources movably, e.g., around this immobile source.

It is also possible not to impose any limit on the degrees of freedom, thus making it possible to have mobile assemblies with 1–N axis/axes of rotation.

The invention claimed is:

1. Multibeam antenna with adjustable pointing, comprising a single reflection arrangement and a plurality of radiating sources arranged opposite the reflection arrangement and configured to emit and/or receive radiofrequency signals, the reflection arrangement defining a centre, a focal plane and a focal point located on the focal plane;

wherein at least one of the radiating sources, socalled mobile source, is movable substantially independently of the or each other radiating source on a scanning surface to adjust the pointing of the antenna, the scanning surface coinciding with the focal plane or being tangential to it at the focal point;

wherein the movable source is movable within the scanning surface according to at least two degrees of freedom;

wherein each of the two degrees of freedom comprises rotation about an axis, one of which axes being called primary axis of rotation and the other a secondary axis of rotation; and further including, for the movable source, a support fixed on a baseplate and comprising an upper arm that rotates about the primary axis of rotation of the corresponding movable source and an arm that rotates about the secondary axis of rotation of the corresponding movable source and defines a mounting end of the movable source;

wherein the movable source is extending along a source axis, the associated secondary axis of rotation being different from the source axis of the radiating source.

2. Antenna according to claim 1 wherein:

the primary axis of rotation and the secondary axis of rotation are perpendicular to the focal plane, the scanning surface then coinciding with the focal plane, or the primary axis of rotation is perpendicular to the focal plane and passes through the focal point of the reflection arrangement, and the secondary axis of rotation is inclined relative to the focal plane such that, in all positions, the movable source is orientated towards the centre of the reflection arrangement, the scanning surface being then tangential to the focal plane at the focal point, or the primary axis of rotation is located outside of the focal point, and the primary axis of rotation and the secondary axis of rotation are inclined relative to the focal plane, such that, in all positions, the movable source is orientated towards the centre of the reflection arrangement, the scanning surface then being tangential to the focal plane at the focal point.

3. Antenna according to claim 1, wherein the primary axis of rotation is translationally fixed.

4. Antenna according to claim 1, including several movable sources analogous to said movable source.

5. Antenna according to claim 4, wherein the primary axes of rotation of the movable sources are arranged symmetrically around the focal point.

6. Antenna according to claim 1, wherein the or each support further comprises at least one stepper motor configured to rotate the upper arm or the arm of the support about the corresponding axis.

7. Antenna according to claim 1, wherein the or each support further comprises at least one rotating joint connecting the upper arm to the baseplate or the arm to the upper arm of the support, the rotating joint is being configured to transmit the radiofrequency signals and/or electrical current between these elements.

8. Antenna according to claim 7, wherein the or each rotating joint comprises at least one channel for transmitting the radiofrequency signals, the transmission channel being delimited by a plurality of plugs spaced apart from one another.

9. Antenna according to claim 1, wherein the arm of the/each support rotates within a rotation surface, so called upper rotation surface, and at least one part of the upper arm of the support rotates within a plane of rotation, so called lower plane of rotation, the lower plane of rotation being parallel to the focal plane and the upper rotation surface lying between the focal plane and the lower plane of rotation.

10. Antenna according to claim 9, wherein, when it comprises several movable sources, the lower planes of rotation of the upper arms of at least two supports coincide between them.

11. Antenna according to claim 9, wherein, when it comprises several movable sources, the upper rotation surface and the lower plane of rotation of the arm and the upper arm of at least one support are comprised between the scanning surface and the upper rotation surface and the lower plane of rotation of the arm and upper arm of at least one other support.

12. Antenna according to claim 9, wherein, when it comprises several movable sources, the upper rotation surface of the arm of at least one support is comprised within the lower plane of rotation of the upper arm of at least one other support.

13. Antenna according to claim 1, wherein the reflection arrangement is mobile.

14. Antenna according to claim 1, wherein the reflection arrangement are formed only by one or several reflectors.

* * * * *